United States Patent [19]

Pries

[11] 4,197,164

[45] Apr. 8, 1980

[54] COKE OVEN APPARATUS

[75] Inventor: Erich Pries, Bochum, Fed. Rep. of Germany

[73] Assignee: Dr. C. Otto & Comp. G.m.b.H., Bochum, Fed. Rep. of Germany

[21] Appl. No.: 920,585

[22] Filed: Jun. 29, 1978

[30] Foreign Application Priority Data

Jul. 5, 1977 [DE] Fed. Rep. of Germany ..... 2730221

[51] Int. Cl.[2] ..... C10B 27/06; C10B 45/00

[52] U.S. Cl. ..... 202/256; 196/136; 202/262; 202/263; 202/269

[58] Field of Search ..... 202/254, 255, 263, 269, 202/256, 257, 258, 262; 196/136

[56] References Cited

U.S. PATENT DOCUMENTS

| | | | |
|---|---|---|---|
| 3,243,360 | 3/1966 | Wethly | 202/256 |
| 3,580,815 | 5/1971 | Tucker | 202/254 X |
| 3,876,507 | 4/1975 | Koddenberg et al. | 202/256 |
| 3,890,206 | 6/1975 | Wunsch | 202/254 |
| 3,956,073 | 5/1976 | Carbone et al. | 202/254 |
| 4,010,079 | 3/1977 | Faber | 202/254 X |

*Primary Examiner*—Michael S. Marcus

*Attorney, Agent, or Firm*—Thomas H. Murray; Clifford A. Poff

[57] ABSTRACT

A coke oven construction is provided having a vertical ascension pipe connected by an elbow to a gas-collecting main. A water seal is placed between the elbow and the collecting main and carries a stream jet aspirating pump. The seal and pump are movable in and out of position and the pump can be closed off.

4 Claims, 5 Drawing Figures

COKE OVEN APPARATUS

BACKGROUND OF THE INVENTION

The invention concerns coking oven apparatus in which a water seal is provided as the bottom seal of an elbow connecting the top end of an ascension or riser pipe with a gas-collecting main.

In order to alleviate the stresses which are produced by the charging gas when charging and leveling the coking oven, a powerful suction is often produced in the oven chamber's gas-collecting space in order to draw-off the charging gas through the ascention pipe into the collecting main. A known arrangement provides for the incorporation of a steam-jet nozzle or aspirator together with an injection nozzle for the collecting-main flushing water in the upper part of the elbow connecting the upper end of the ascension tube and the collecting main. The suction thus produced was, in many cases, insufficient, so that part of the charging gas escaped through the charging holes and caused stresses to occur.

The objective of the invention is to provide an apparatus whereby a suction is produced in the gas-collecting space which is so strong that escape of the charging gas is prevented, there being additionally provided a water-seal as the bottom closure of the elbow or which connects the upper end of the ascension tube with the gas-collecting main.

It is also known, in connection with drawing off the charging gas from the oven chamber while it is being charged with coal, to utilize a steam jet pump or aspirator for the purpose of controlling and limiting the pressure in the upper gas-collecting space. By this is meant a steam nozzle associated with a constricted passage, preferably a Venturi tube, through which the gas flows.

SUMMARY OF THE INVENTION

In accordance with the invention, a jet pump which is to be actuated in association with the charging process is installed at the level of the water seal in such a way that, during the charging operation, a connection is provided between the elbow and the collecting main through the jet pump. By this means, it is possible to produce such a large underpressure in the ascension tube and in the gas-collecting space of the oven chamber that the gas cannot escaoe through the charging holes or through the opening of the leveling door and, as a result, no emissions occur.

The jet pump can be installed in the base of the water seal and can be made closeable together with the water seal by a swingably-mounted base plate.

It is also possible to install the jet pump in a swingably-mounted plate which closes-off the opening between the elbow and the collecting main and to construct the water-seal in such a way that when it is in the swung-in position it is engaged below the swingable plate.

It is also possible to mount above the water seal a plate which is provided with an orifice and which is rotatable around a hollow shaft, and to provide, associated with the orifice a steam jet which is supplied via the hollow shaft.

By means of the new arrangement, the fullest use is made of the good sucking action of the steam jet pump without in any way constricting the cross-section, which would hinder the withdrawal of the production gas.

The appended drawings illustrate three constructional examples of the new device in which.

Figure 2:
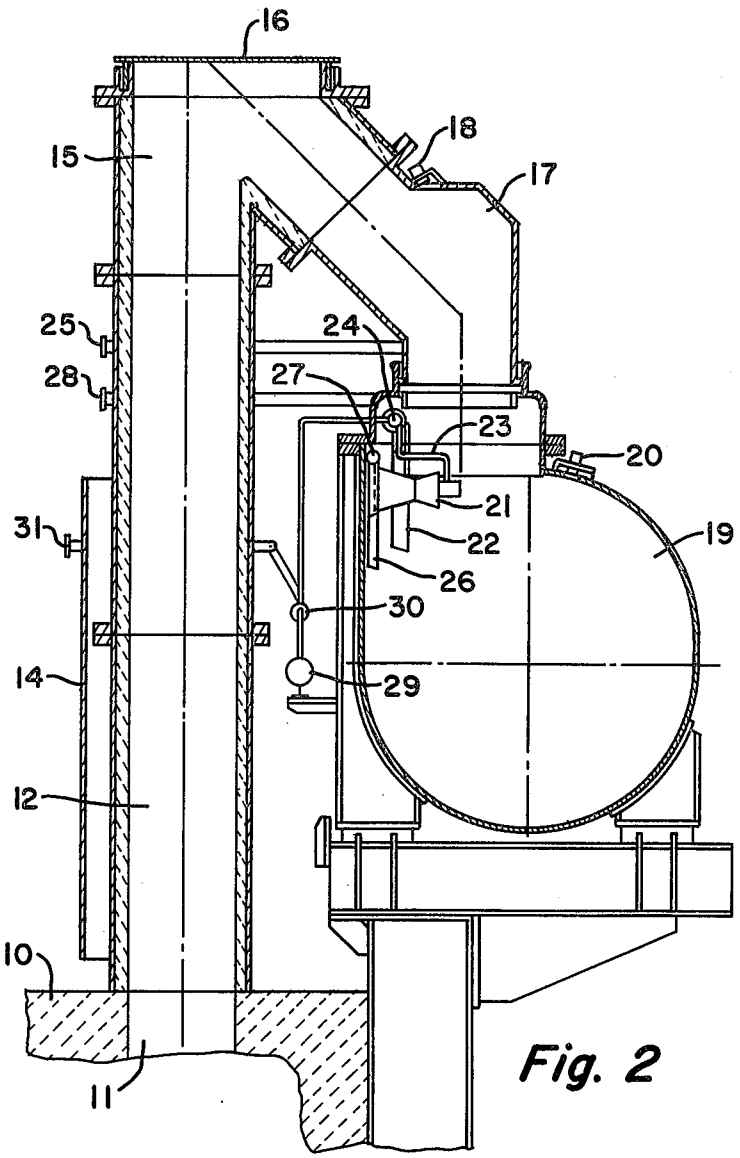
FIG. 2 shows the same apparatus in the position in which the production-gas is sucked into the collecting main.

10 denotes the oven roof having an opening 11 in which is inserted the ascention pipe 12. The ascension pipe is provided with a fireproof lining 13 and is also provided, in its lower part, with a protective casing 14. 15 is a connecting piece between ascension tube 12 and elbow 17 which leads to collecting main 19. It is closed-off by a cover-plate 16 having a flange which projects into a water containing channel, so that a gastight seal is formed. Mounted in elbow 17 is a nozzle 18 for admitting the water for flushing-out the collecting main.

A water nozzle 20 is mounted in collector main 19. Water is supplied to nozzles 18 and 20 via a pipe-line system (not shown). A water receptacle or cup 22 adapted to form a seal is disposed at the bottom of the elbow 17 and is mounted on and rotatable around the hollow shaft 24 by means of push rod 25.

A jet pump 21 mounted in the water receptacle 22 and is provided with a steam inlet 23. Steam is supplied via hollow shaft 24 from the steam-distributing pipe-line 29 through valve 30 which can be actuated by push-rod 31. The lower discharge opening of jet pump 21 can be closed-off gas-tight by means of base-plate 26 which can be rotated around shaft 27 by means of push-rod 28.

Figure 1:
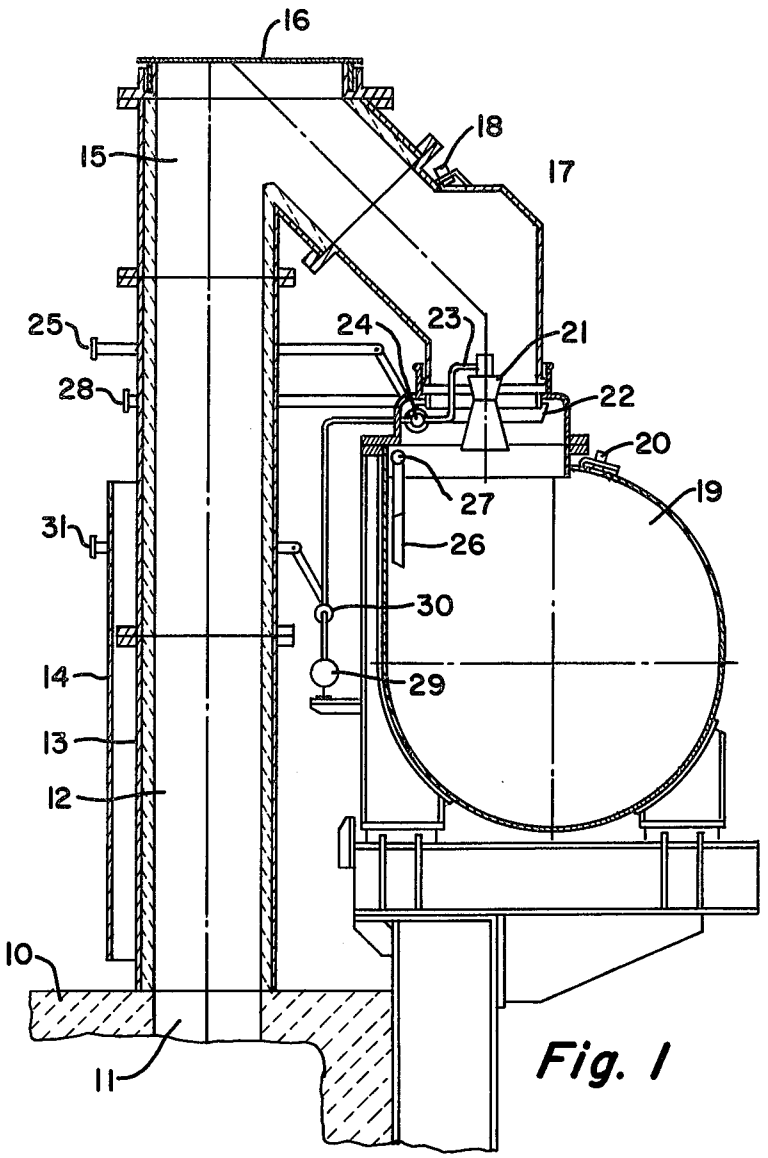
FIG. 1 shows a form of construction in which the jet pump is firmly mounted in the base of the water seal, and is shown in the position in which the charging gas is sucked-off.

The apparatus of FIGS. 1-3 operates in the following manner. After the oven chamber has been emptied and the doors replaced in position, with the apparatus in the position shown in FIG. 1, the jet pump 21 is supplied with steam. The covers are then lifted from the charging car (not shown) and the oven chamber is charged with coal. During the entire charging process and until after conclusion of the leveling operation, so great a suction is produced in the ascension pipe and in the upper gas-collecting space by means of the jet pump that no emissions take place from the filling holes or the leveling door. When the leveling door is closed, the supply of steam is interrupted by closing valve 30 by means of push-rod 31, and water seal 22, which carries jet pump 21, is brought to the open position (FIG. 2) by push-rod 25, so that the passage is clear for the production-gas to pass through. All the push rods can be actuated from the charging car.

Figure 3:
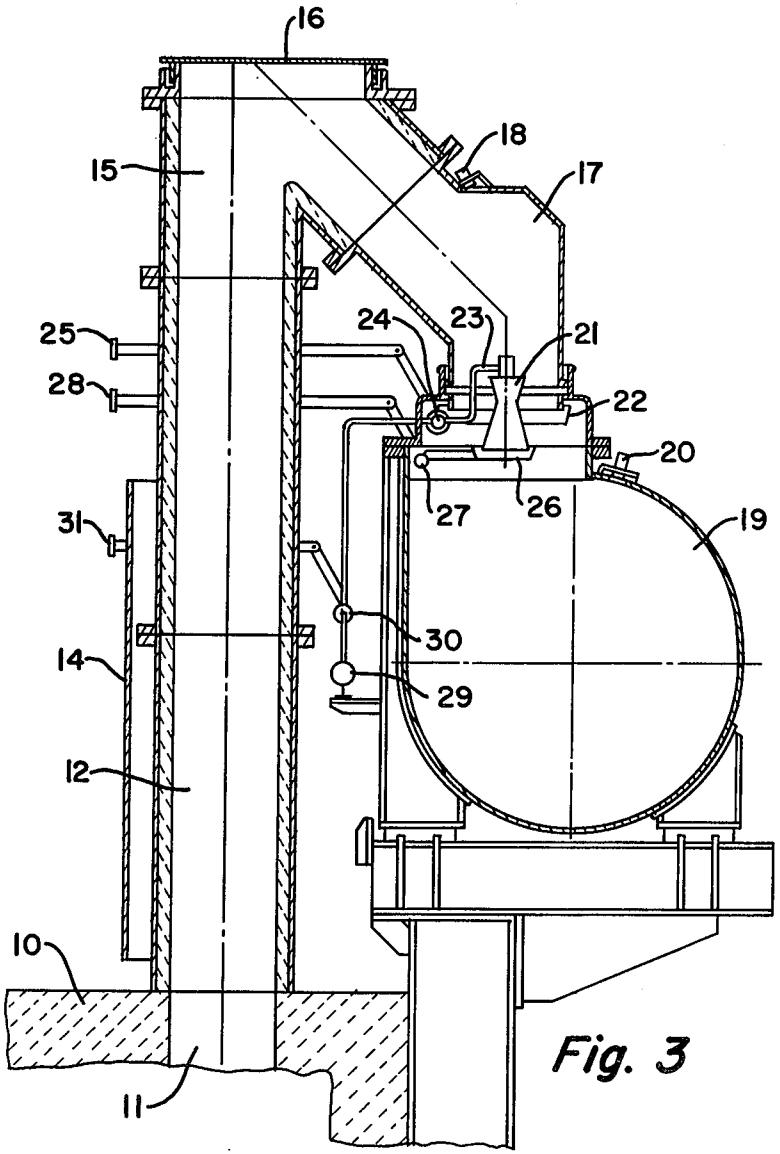
FIG. 3 shows the same device when shutting-off the ascension pipe from the collecting main.

Should it be necessary for the oven chamber to be shut-off from the collecting main, then, as shown in FIG. 3, both water receptacle 22 and base-plate 26 are brought into the horizontal position. The receptacle 22 is then filled with water sprayed from nozzle 18 and the resulting immersion ensures a gas-tight seal.

Figure 4:
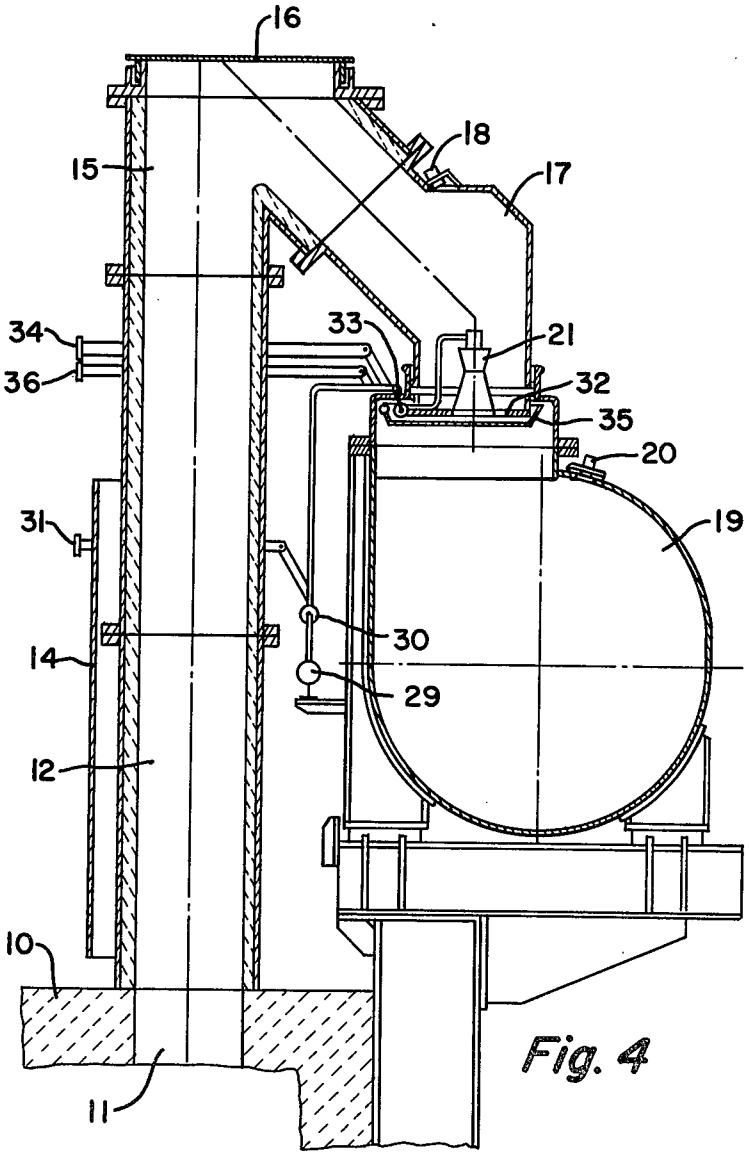
FIG. 4 shows a variant in which the jet pump is mounted in a tiltable plate and holds a water seal, when in the swung-in position, under the tiltable plate.

In the embodiment illustrated in FIG. 4, jet pump 21 is mounted on a base-plate 32 which is itself mounted on hollow shaft 33 and can be rotated about the shaft by means of push-rod 34.

Sealing of the jet pump is effected by means of a water seal receptacle 35 located below base-plate 32. The receptacle 35 can be moved in and out of sealing position by means of push-rod 36.

Figure 5:
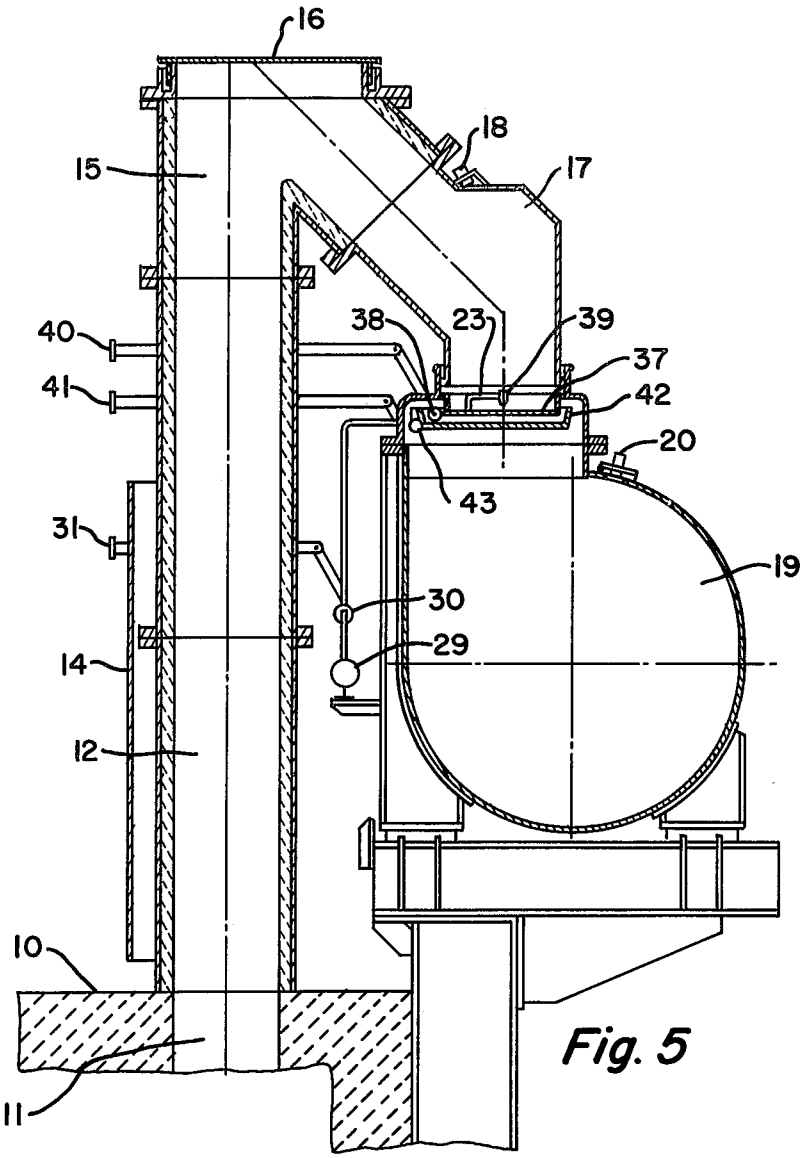
FIG. 5 shows a variant in which a plate is mounted above the water seal, the plate being rotatable around a hollow shaft and provided with an aperture.

In FIG. 5, the water seal receptacle is indicated by 42. It can be rotated around shaft 43 by means of push-rod 41. Disposed above receptacle 42 is a plate 37 in which there is a central orifice. The plate 37 can be rotated around hollow shaft 38 by means of push rod 40. The steam is fed through hollow shaft 38 from pipe-line 23 to nozzle 39 associated with orifice.

I claim:

1. Coke oven apparatus including means defining a coke oven chamber, including a vertical ascension pipe connected to said coke oven chamber, a gas-collecting main, an elbow connecting the upper end of said ascension pipe to said collecting main, a water seal means between said elbow and said collecting main, and a steam jet pump means associated with said water seal means in a manner for use to provide the sole gas transfer connection between said elbow and said collecting main.

2. Coke oven apparatus as defined in claim 1 in which said steam jet pump means is mounted in said water seal means, and including a movable base plate for closing off the pump.

3. Coke oven apparatus as defined in claim 1 in which said steam jet pump means is mounted on a movable plate closing the connection between said elbow and said collecting main, and said water seal means is movably mounted below said movable plate.

4. Coke oven apparatus as defined in claim 1 wherein said water seal means is movably mounted, and said steam jet pump means includes a plate having a central orifice disposed above said water seal means, a steam supply pipe rotatably supporting said plate central orifice, and a nozzle associated with said orifice and connected to said steam supply pipe.

* * * * *